US006783159B2

(12) United States Patent
Tuttle et al.

(10) Patent No.: US 6,783,159 B2
(45) Date of Patent: Aug. 31, 2004

(54) COMPACT RETRACTABLE LABEL

(75) Inventors: Erick J. Tuttle, Fort Collins, CO (US); Arlen L. Roesner, Fort Collins, CO (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 31 days.

(21) Appl. No.: 10/285,907

(22) Filed: Oct. 31, 2002

(65) Prior Publication Data

US 2004/0084897 A1 May 6, 2004

(51) Int. Cl.[7] ..... B42D 15/00

(52) U.S. Cl. ..... 283/81; 156/357; 156/571; 283/117

(58) Field of Search ..... 283/81, 101, 117; 156/567, 568, 569, 570, 571, 572, 357

(56) References Cited

U.S. PATENT DOCUMENTS 3,867,233 A * 2/1975 Eder et al. ..... 156/571
4,226,660 A * 10/1980 Carter ..... 156/357
4,302,277 A * 11/1981 Ilsemann ..... 156/567
5,276,435 A 1/1994 Rossides
5,715,136 A 2/1998 Noe et al.
5,822,182 A 10/1998 Scholder et al.
5,864,126 A 1/1999 Hutton, Jr.
6,129,388 A 10/2000 Bromberg
6,148,419 A 11/2000 Ahrens et al.
6,301,622 B1 10/2001 Kim et al.
6,418,651 B1 7/2002 Joliey
6,689,243 B2 * 2/2004 Scott et al. ..... 156/215
2001/0021474 A1 9/2001 Hamada
2002/0043011 A1 4/2002 Edwards
2002/0084020 A1 * 7/2002 Scott et al. ..... 156/215

* cited by examiner

*Primary Examiner*—Monica S. Carter
(74) *Attorney, Agent, or Firm*—Kevin M. Hart

(57) ABSTRACT

A compact retractable label assembly includes a flexible label tongue and a guide bracket for receiving the label tongue. The guide bracket is adapted to mount to the inside of an enclosure surface such that the label tongue may be pulled from a mouth of the bracket to the outside of the enclosure surface. The guide bracket has a curved profile so that the label tongue bends when it is pushed inside the enclosure. The bend in the excursion path of the label tongue preserves space inside the enclosure.

9 Claims, 9 Drawing Sheets

COMPACT RETRACTABLE LABEL

FIELD OF THE INVENTION

This invention relates to techniques for attaching information labels to equipment such as computers.

BACKGROUND

Labels are sometimes placed on equipment to make important information about the equipment readily observable. For example, labels are sometimes used on items of electrical equipment to record the item's serial number or LAN ID or the like. One labeling technique employs a retractable label that can be retracted into the equipment enclosure when not in use, but can be pulled out of the enclosure for reading. Retractable labels are aesthetically advantageous because they are not visible when retracted. On the other hand, because they retract into the interior of the equipment, sufficient room within the enclosure must be provided in order to receive the retracted label. Consequently, limitations exist as to where a prior art retractable label may be placed on an enclosure. It would be desirable to have a retractable label design that facilitates a wider variety of placement options than do the retractable labels of the prior art.

SUMMARY OF THE INVENTION

A retractable label assembly according to the invention includes a flexible label tongue and a guide bracket for receiving the label tongue. The guide bracket is adapted to mount to the inside of an enclosure surface such that the label tongue may be pulled from a mouth of the bracket to the outside of the enclosure surface. The guide bracket has a curved profile so that the label tongue bends when it is pushed inside the enclosure. The bend in the excursion path of the label tongue preserves space inside the enclosure.

DETAILED DESCRIPTION OF THE PREFERRED EMBODIMENTS

A retractable label assembly 100 according to a preferred embodiment of the invention includes a flexible label tongue

Figure 1:
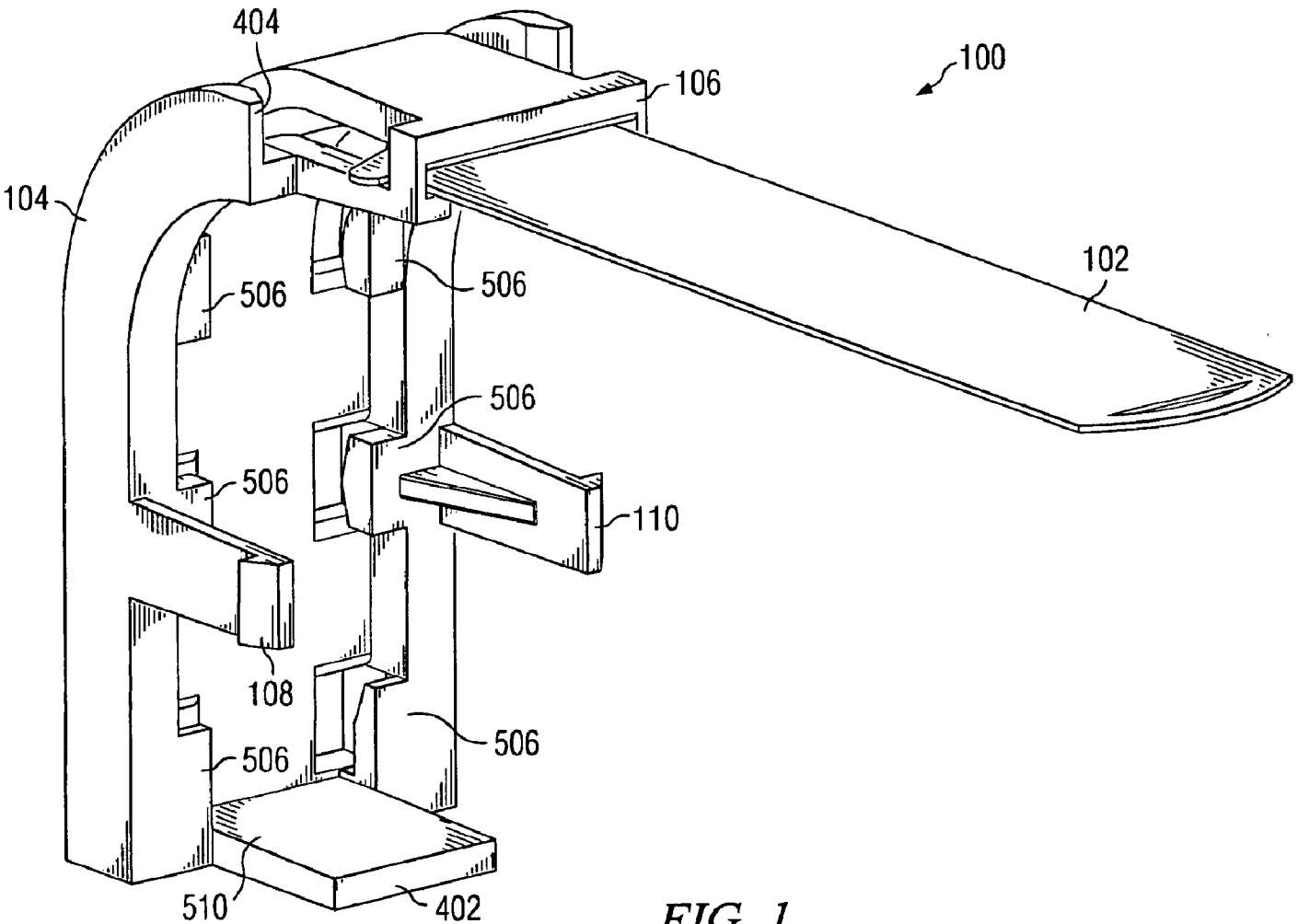
FIG. 1 is an oblique view of a retractable label assembly according to a preferred embodiment of the invention shown with the label tongue extended.
Figure 2:
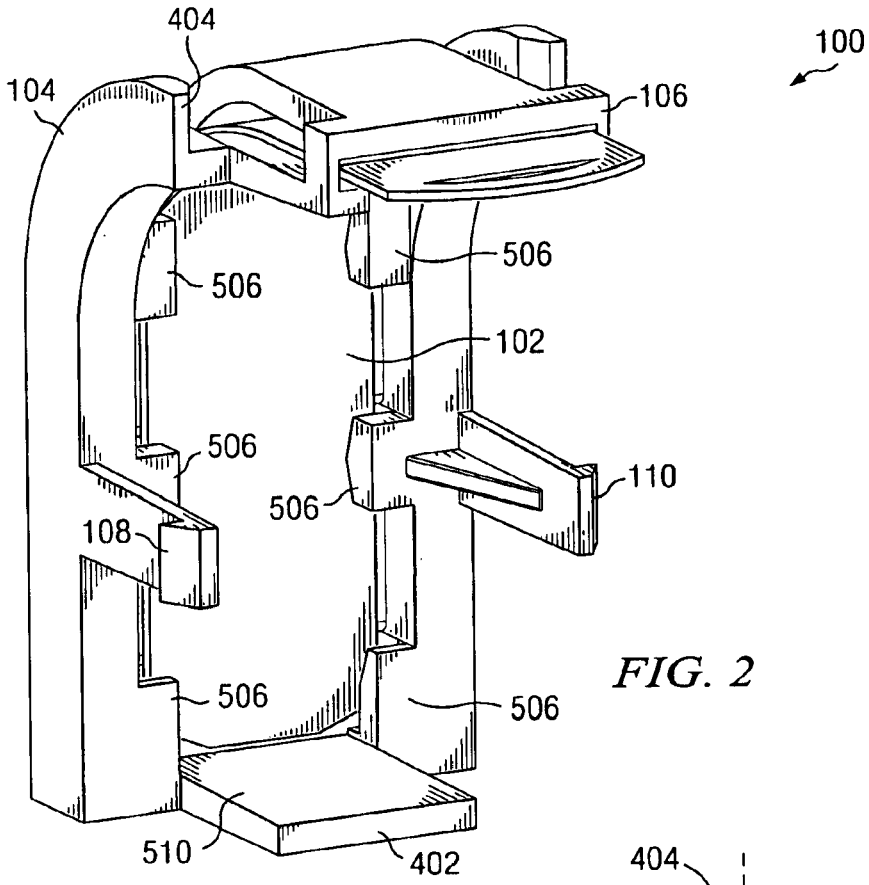
FIG. 2 is an oblique view of the retractable label assembly of FIG. 1 shown with the label tongue retracted.
Figure 3:
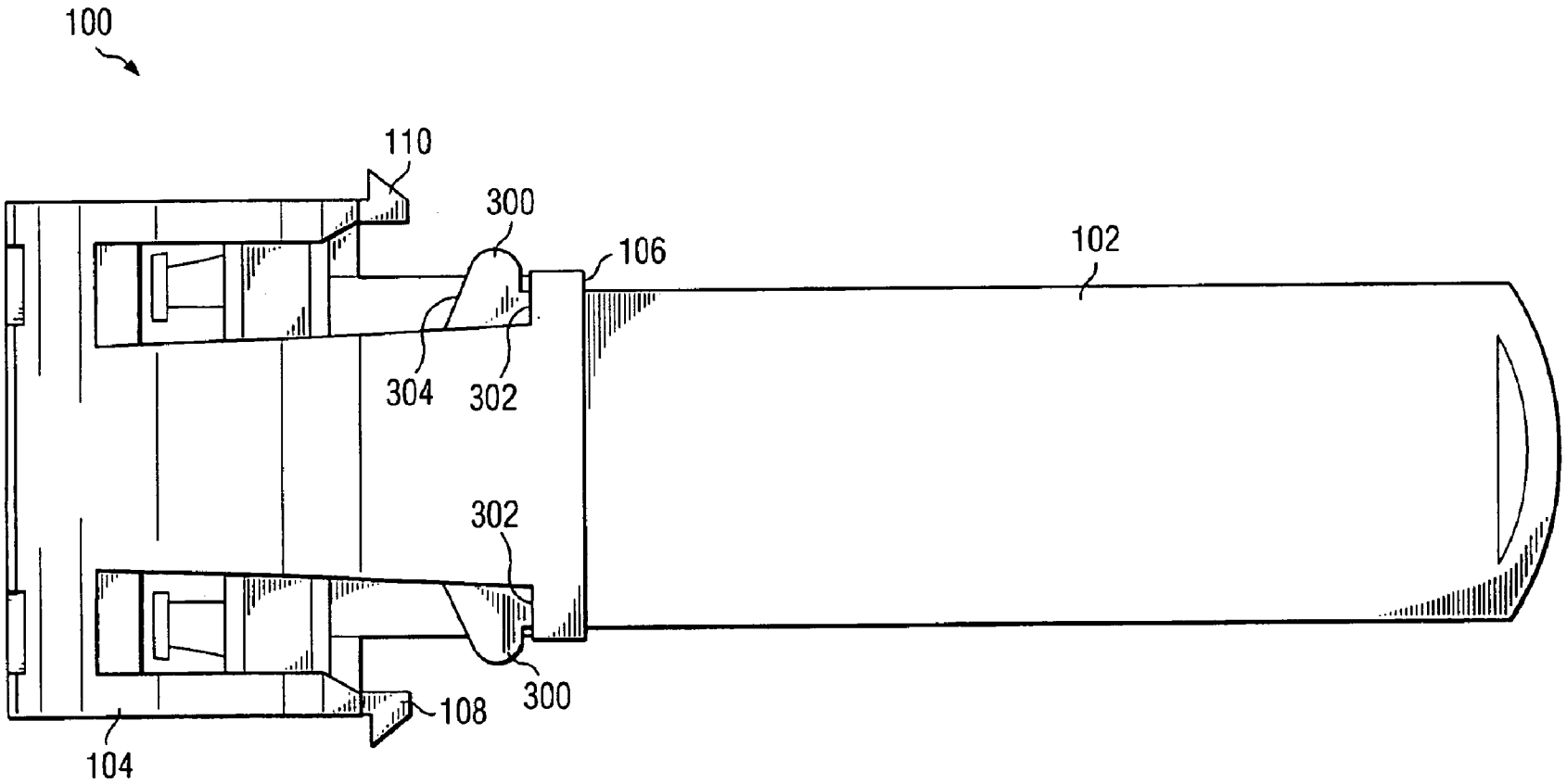
FIG. 3 is a top view of the retractable label assembly of FIG. 1 shown with the label tongue extended.

102 and a guide bracket 104 for receiving the label tongue. FIGS. 1 and 3 show tongue 102 in an extended position. FIG. 2 shows tongue 102 in a retracted position. As is apparent from the side view shown in FIG. 4, bracket 104 has a curved profile to that flexible label tongue 102 bends when it is pushed inside bracket 104. In the embodiment shown, bracket 104 bends approximately 90 degrees. In other embodiments, other degrees of bending may be employed depending on the compactness requirements of the application. Bracket 104 may be made of any relatively rigid material. Tongue 102 may be made of any relatively flexible material. In one embodiment, both bracket 104 and tongue 102 may both be made of plastic having suitable properties.

To prevent tongue 102 from being pulled all the way out of bracket 104, removal stops 300 may be provided at the tail end 304 of tongue 102. Shoulders 302 disposed at bracket mouth 106 engage stops 300 as tongue 102 is pulled out, effectively preventing further outward movement of tongue 102.

Figure 6:
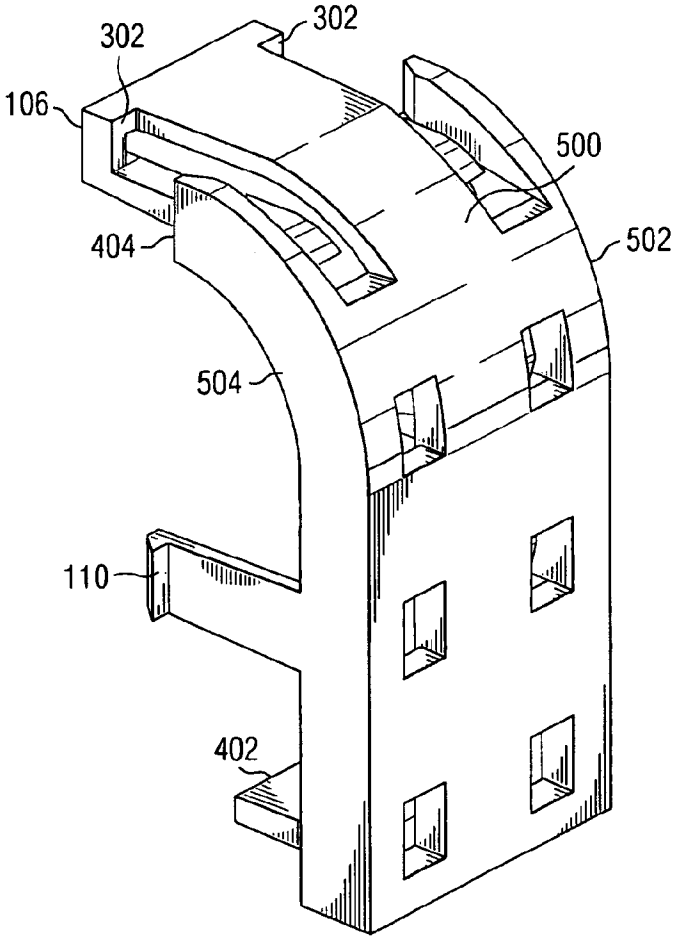
FIGS. 5 and 6 are front and back oblique views of the bracket of FIG. 4.
Figure 5:
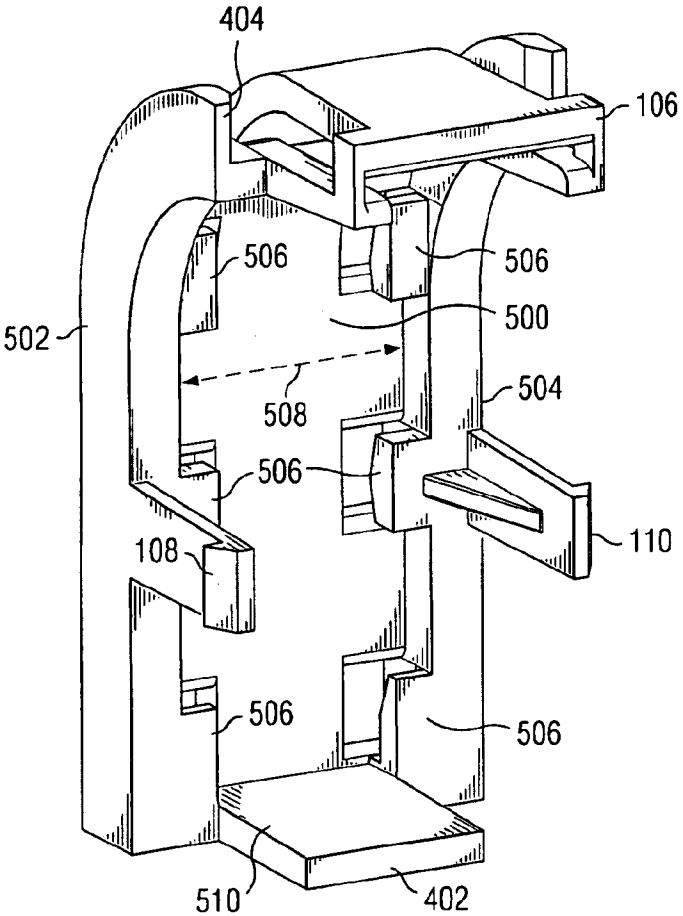

As can be seen in FIGS. 5 and 6, bracket 104 may include a curved surface 500 having left and right sides 502, 504. A plurality of tabs 506 may be located adjacent curved surface 500 along its left and right sides 502, 504. Together, surface 500, sides 502, 504, and tabs 506 define a channel 508 in which tongue 102 moves. Preferably, enough space should be provided between tabs 506 and surface 500 to allow tongue 102 to move relatively freely in channel 508. Channel 508 is terminated at one end as indicated at 510. Preferably, the total length of channel 508 from mouth 106 to termination 510 should not be longer than the length of tongue 102, so that tongue 102 may not inadvertently be pushed so far into bracket 104 that it cannot easily be retrieved.

Figure 7:
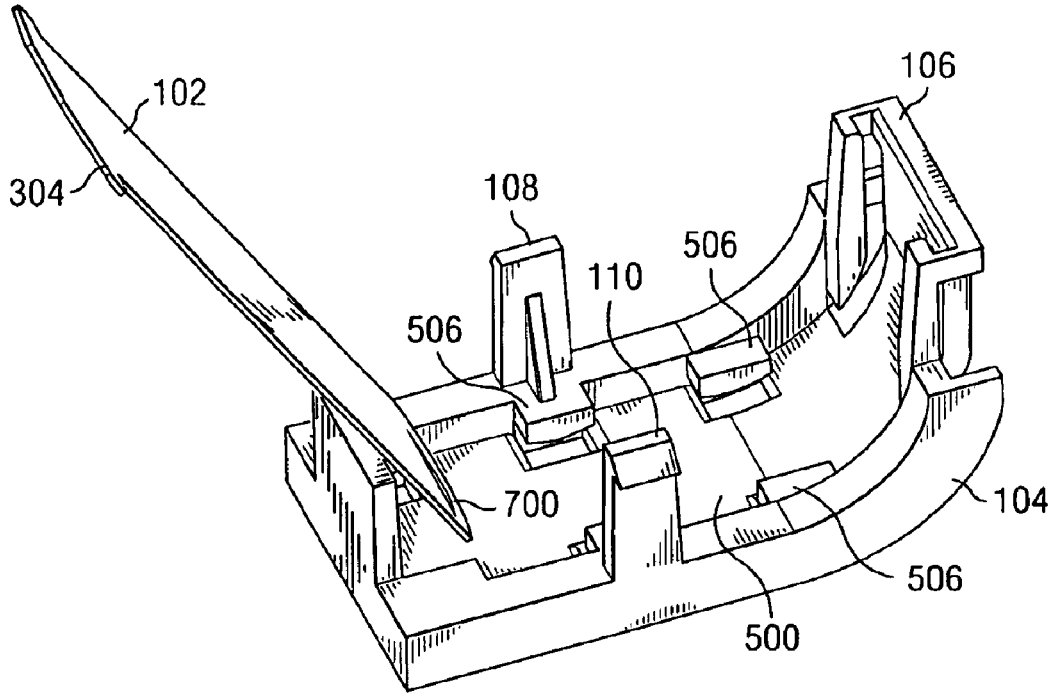
FIGS. 7–10 are assembly views illustrating a preferred manner of installing the label tongue into the bracket.
Figure 8:
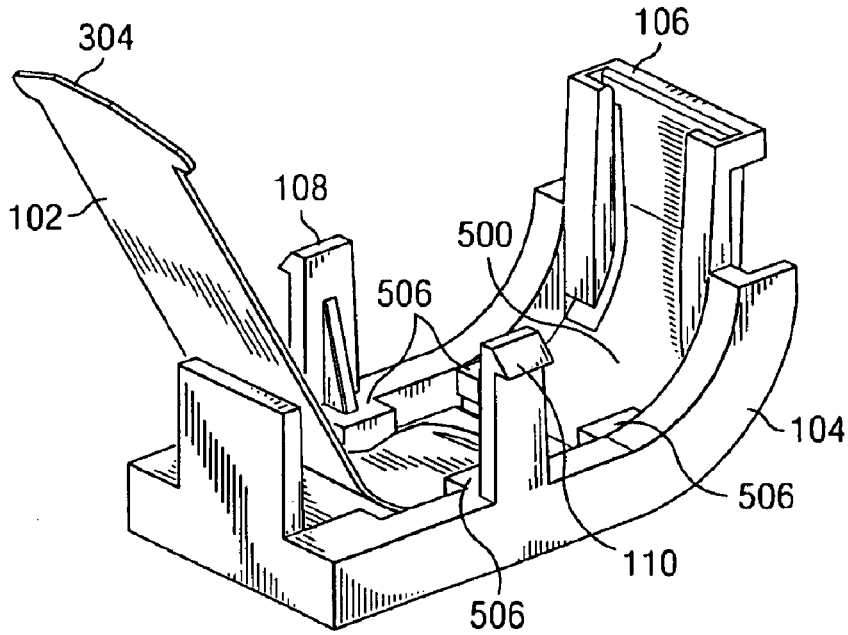
Figure 9:
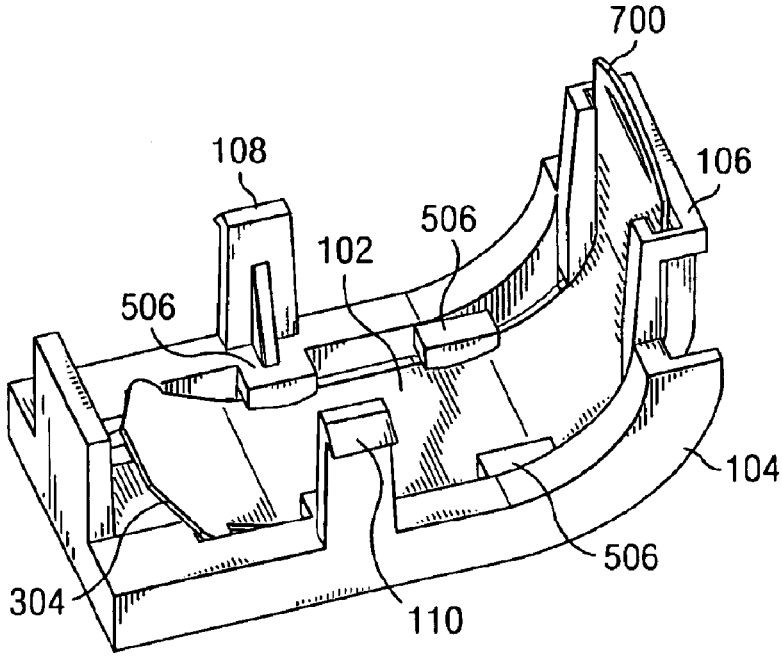
Figure 10:
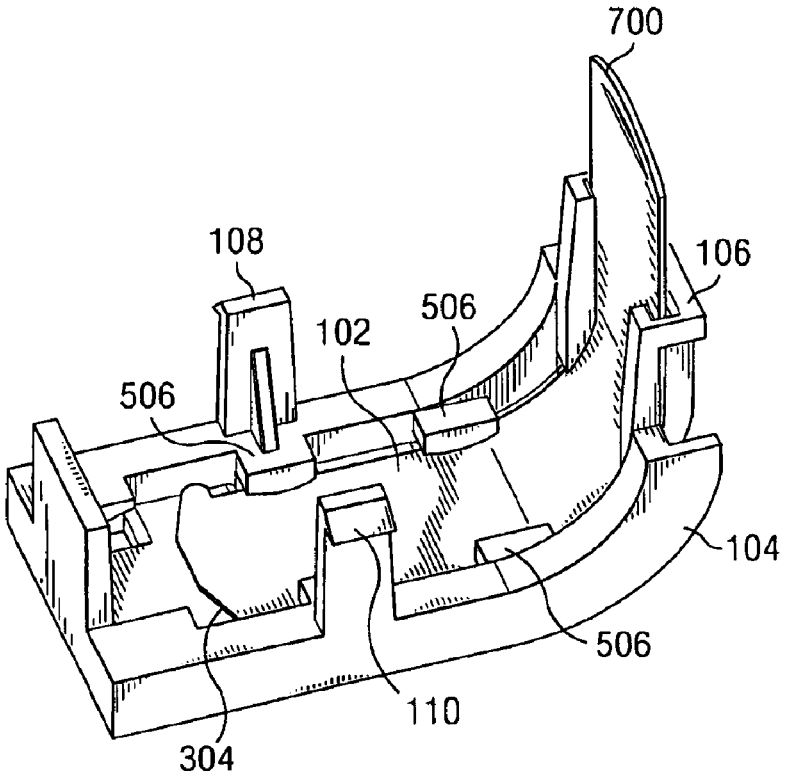
Figure 11:
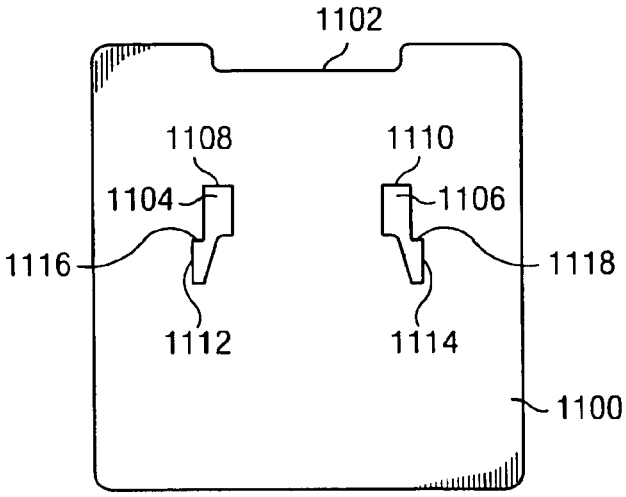
FIG. 11 is an orthogonal plan view of a preferred mounting surface for receiving the bracket.

FIGS. 7–10 illustrate a preferred manner for installing tongue 102 into bracket 104. Head end 700 may be inserted into channel 508 between two pairs of tabs 506, as shown in FIG. 7. Then, as shown in FIGS. 8 and 9, tongue 102 may be fed further into channel 508 so that head end 700 travels toward mouth 106. Finally, as shown in FIG. 10, tail end 304 of tongue 102 snaps into channel 508. Once this has occurred, tail end 304 of tongue 102 tends to remain pressed against surface 500 due to the elastic tendency of tongue 102 to straighten.

Figure 4:
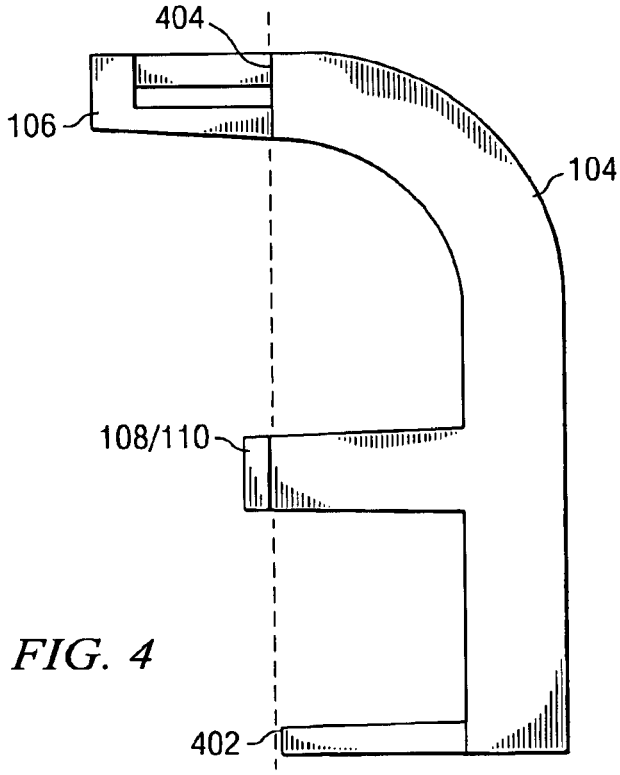
FIG. 4 is a side view of the bracket of FIG. 1.

Bracket 104 is adapted to be mounted to the inside of an enclosure surface 400 so that tongue 102 may be pulled from bracket mouth 106 through an opening in the enclosure and then pushed back in again. One way to accomplish the mounting is to provide first and second support surfaces 402, 404 on bracket 104, and to provide left and right catches 108, 110 between support surfaces 402, 404 as shown. As illustrated in FIG. 4, support surfaces 402, 404 are adapted to engage the inside of enclosure surface 400, and catches 108, 110 are adapted to extend through enclosure surface 400 to catch the outside of the surface.

Figure 12:
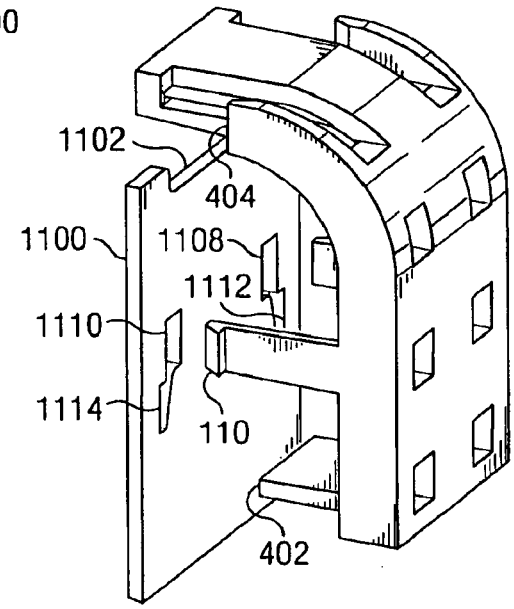
FIGS. 12–16 are assembly views illustrating a preferred manner of installing the bracket onto the mounting surface of FIG. 11.
Figure 13:
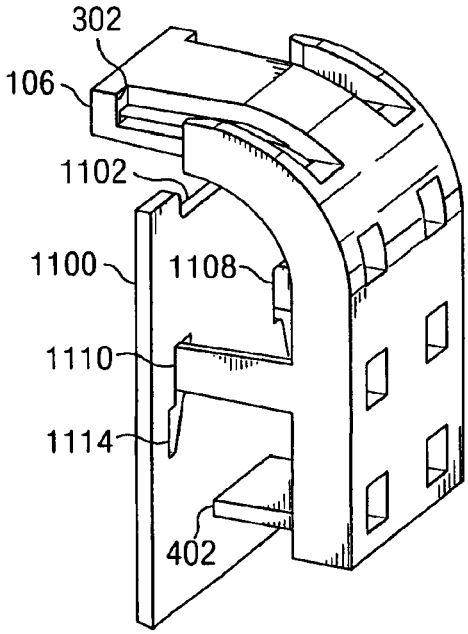
Figure 16:
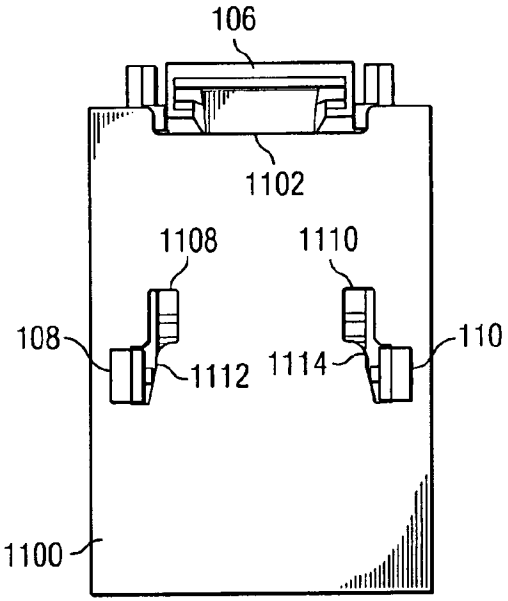
Figure 15:
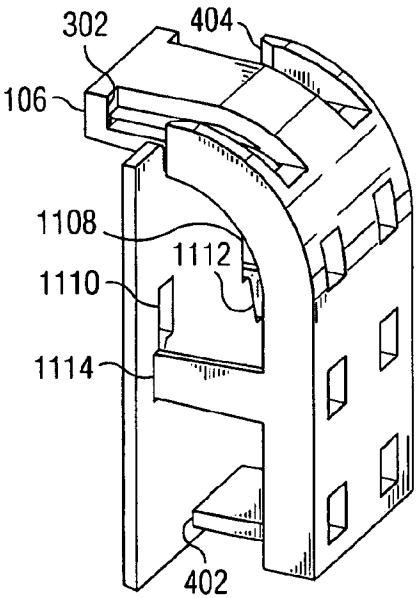
Figure 14:
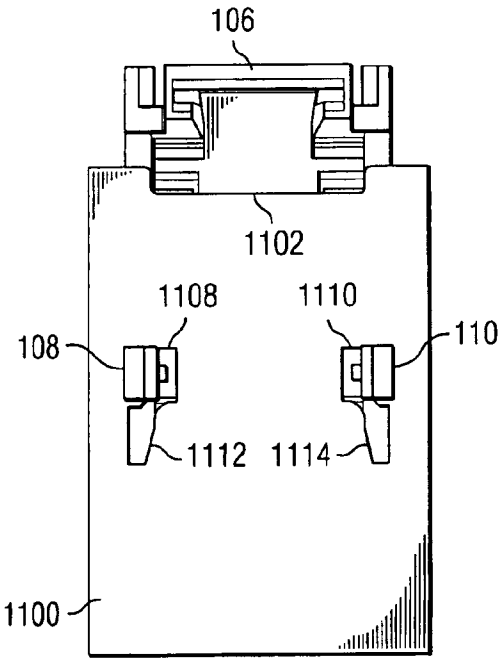

A preferred manner of engaging bracket 104 to a surface 1100 securely is illustrated in FIGS. 11–16. An indentation or hole 1102 may be provided in surface 1100 for receiving mouth 106 of bracket 104, and left and right holes 1104, 1106 may be provided for receiving catches 108, 110. Catches 108, 110 are first inserted into larger hole areas 1108, 1110 so that catches 108, 110 are engaged with the surface, as shown in FIGS. 12, 13 and 14. Then, bracket 104 may be translated downward to the position shown in FIGS. 15 and 16, wherein catches 108, 110 have moved into smaller hole areas 1112, 1114. Once catches 108, 110 have moved into the smaller hole areas, they cannot be disengaged from surface 1100 until bracket 104 has translated upward again. But such a movement is unlikely to occur inadvertently or due to mere vibration, for example, because of the presence of shoulders 1116 and 1118. Instead, catches 108, 110 must be intentionally pressed toward one another to clear shoulders 1116, 1118 if bracket 104 is to be translated upward and removed from surface 1100.

Figure 17:
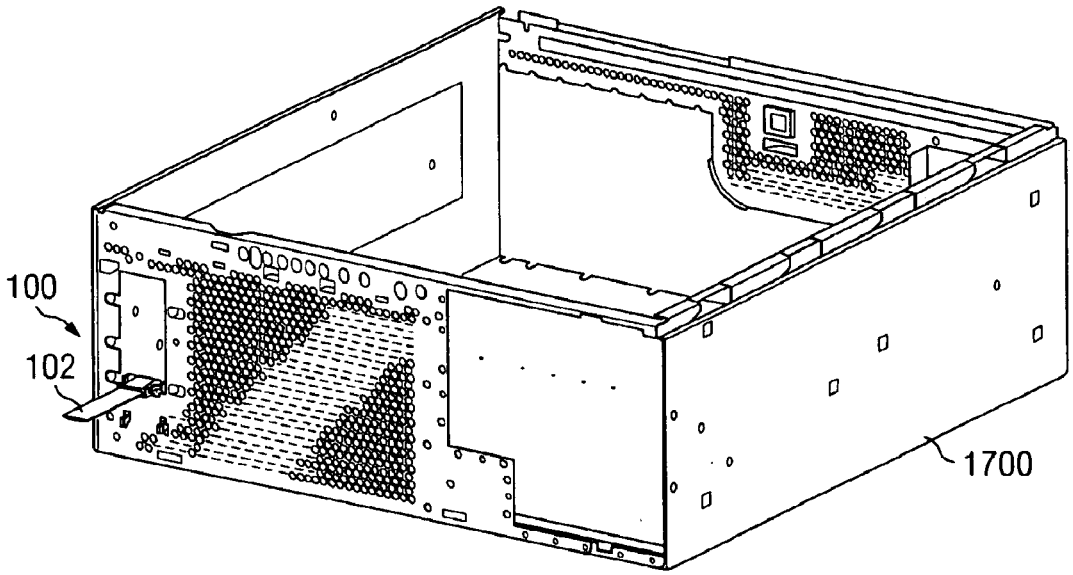
FIGS. 17 and 18 are oblique views of a computer chassis incorporating a label assembly according to a preferred embodiment of the invention.
Figure 18:
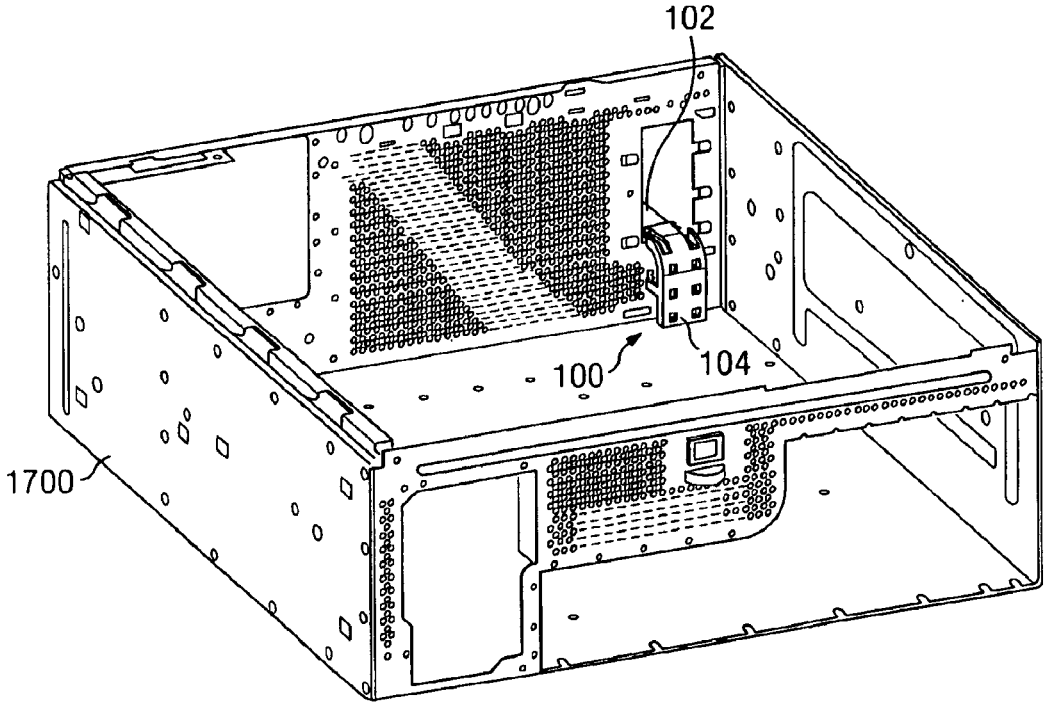

FIGS. 17 and 18 provide an illustrative example of one of the many ways in which a compact retractable label assembly 100 may be mounted in a chassis 1700 of a piece of equipment such as a computer. The assembly 100 may be mounted to any of the surfaces of the enclosure, and at any location on such surfaces, and in any orientation.

Other modifications may also be made to the illustrated embodiments without deviating from the scope of the invention as defined by the following claims and their equivalents.

What is claimed is:

1. A retractable label assembly, comprising:

a flexible label tongue; and a guide bracket for receiving the label tongue;

wherein the guide bracket is adapted to mount to an inside of an enclosure surface such that the label tongue may be pulled from a mouth of the bracket to an outside of the enclosure surface; and wherein the guide bracket comprises a curved profile so that the label tongue bends when it is pushed inside the enclosure.

2. The retractable label assembly of claim 1, wherein: the curved profile of the guide bracket bends approximately 90 degrees.

3. The retractable label assembly of claim 1, wherein:

the label tongue comprises removal stops at a tail end; and the mouth of the bracket comprises shoulders for engaging the removal stops to prevent the tail end from exiting the mouth.

4. The retractable label assembly of claim 1, wherein the bracket comprises:

a curved surface having left and right sides; and a plurality of tabs disposed adjacent the curved surface along the left and right sides;

wherein the tabs and the curved surface define a channel in which the label tongue moves.

5. The retractable label assembly of claim 4, wherein:

the channel is terminated at one end; and a length of the channel is not greater than the length of the tongue.

6. The retractable label assembly of claim 1, wherein the bracket comprises:

first and second support surfaces for engaging the inside of the enclosure surface; and left and right catches disposed between the first and second support surfaces and adapted to extend through the enclosure surface to catch the outside of the enclosure surface.

7. The retractable label assembly of claim 6, wherein the enclosure surface comprises left and right holes for receiving the left and right catches; and each of the left and right holes comprises a larger hole area and a smaller hole area, with a shoulder disposed at a junction between the larger hole area and the smaller hole area.

8. The retractable label assembly of claim 7, wherein:

a size of the smaller hole area is such that the catches may not be removed from the enclosure surface while disposed therein.

9. The retractable label assembly of claim 7, wherein:

a location of the shoulders is such that the catches are prevented from moving from the smaller hole area into the larger hole area unless they are first pressed toward one another to clear the shoulders.

* * * * *